United States Patent [19]

Cunningham

[11] Patent Number: 4,822,291

[45] Date of Patent: Apr. 18, 1989

[54] GAS OPERATED ELECTRICAL CONNECTOR

[75] Inventor: Francis V. Cunningham, Western Springs, Ill.

[73] Assignee: Joslyn Corporation, Chicago, Ill.

[21] Appl. No.: 136,440

[22] Filed: Dec. 17, 1987

Related U.S. Application Data

[63] Continuation of Ser. No. 841,844, Mar. 20, 1986, abandoned.

[51] Int. Cl.[4] ..... H01R 13/52

[52] U.S. Cl. ..... 439/187; 439/921

[58] Field of Search ..... 439/181–187, 439/921

[56] References Cited

U.S. PATENT DOCUMENTS

| | | | |
|---|---|---|---|
| 1,717,329 | 6/1929 | Williams | 339/111 |
| 3,915,534 | 10/1975 | Yonkers | 339/14 R |
| 3,958,855 | 5/1976 | Oakes | 439/185 |
| 3,989,341 | 11/1976 | Ball | 339/111 |
| 4,088,383 | 5/1978 | Fischer et al. | 339/111 |
| 4,186,985 | 2/1980 | Stepniak | 339/111 |
| 4,260,213 | 4/1981 | Kotski et al. | 439/185 |
| 4,516,823 | 5/1985 | Filter et al. | 339/111 |
| 4,671,586 | 6/1987 | DeBolt | 439/607 |

*Primary Examiner*—Neil Abrams

*Attorney, Agent, or Firm*—Mason, Kolehmainen, Rathburn & Wyss

[57] ABSTRACT

A high voltage insulated bushing module of the gas operated fault closure type for connection with the probe of a mating insulated elbow module is disclosed. The module includes a snuffer tube adapted to perform as a piston within a piston cylinder cut from a length of drawn aluminum tubing. A connector unit mounted on and carried by the tube is provided to conduct load current in series abutting contact with and between the probe and the cylinder. Fault current arcing struck between an incoming probe contact and the tube mounted connector unit generates gas pressure to drive the tube toward the incoming probe, which in turn pulls the connector unit into connection with the probe contact to extinguish the arc. Alternatively, the connector unit is adapted for connection to an elongated, replaceable nut connected directly to the threaded stud of a mating bushing well, thereby rendering all load current conductive components of the bushing insert to be readily replaceable. The replaceable nut may be installed at a predetermined value of torque to assure that the threaded stud of the bushing well will not be broken during installation. The tube is configured for limiting the travel of the tube and for sealing the tube against gas leakage.

6 Claims, 2 Drawing Sheets

GAS OPERATED ELECTRICAL CONNECTOR

This application is a continuation of application Ser. No. 841,844, filed Mar. 20, 1986, now abandoned.

BACKGROUND OF THE INVENTION

In gas operated high voltage bushings, such as shown in U.S. Pat. Nos. 3,542,986 and 4,088,383, a snuffer tube and female contact carried by a metallic piston are disposed within and connected to a metallic piston cylinder. Under fault current conditions, the tube and contact are pushed onto an incoming probe contact by gas pressure acting against the piston. The entire mass of the snuffer tube, the female contact and the metallic piston must be moved by the gas pressure. In U.S. Pat. No. 4,260,214, a reduction in the mass of the moving parts is achieved through the use of the snuffer tube itself as a piston. The female contacts for the conduction of load current are affixed to the piston cylinder by a press fit, where they remain in stationary position. However, this embodiment requires that an auxiliary set of moving contacts be provided for the extinguishment of a fault current arc.

U.S. Pat. Nos. 3,982,812 and 4,186,985 also show bushing constructions that include massive metallic pistons to push female contacts onto an incoming probe. This use of a metallic piston and a female contact has required a first current conducting connection between the piston and the female contact. In addition, the aforementioned U.S. Pat. Nos. 4,088,383 and 4,186,985 also show flexible contacts positioned between the piston and the confining cylinder, thereby requiring a second conducting connection from piston to flexible contact and a third conducting connection between the flexible contact and the cylinder. Bushing inserts also include a current conducting connection to another component of the distribution system, such as to the threaded stud of a bushing well as disclosed in U.S. Pat. No. 4,353,611. While current carrying connections are necessary in a bushing, they can also be a cause for damage and failure due to loosening or corrosion, leading to faulty conduction and overheating. After damage, it is desirable that all current conducting components be replaceable within a bushing. While prior art bushings have provided for replacement of the female contact and of the metal piston, prior art has not provided a bushing wherein all current conducting components of the bushing are replaceable within the bushing housing. U.S. Pat. No. 4,202,591 is an example of such prior art, wherein the female contact is the only load current conductive component that is readily removable from the bushing insert 30.

SUMMARY OF THE INVENTION

Thus, it is an object of this invention to provide a new and improved bushing that includes load current carrying contacts pulled by a lightweight plastic piston.

Another object of this invention is to provide an improved bushing with less mass to be moved by gas pressure.

Another object of the invention is to provide an improved bushing having fewer potentially detrimental current exchange connections.

Another object is to provide a new and improved bushing having fewer parts and consequently improved quality and lower cost.

Still another object is to provide a new and improved bushing wherein all components provided for the conduction of load current are readily removable from and replaceable within the bushing.

In the preferred embodiments of the present invention the snuffer tube is adapted to serve as the piston to move a connector attached to the tube. The connector provides for the conduction of load current and fault current and for the extinguishment of fault current arcing. These new and improved constructions are achieved by using a lightweight plastic snuffer tube to pull an attached female connector onto contact with an incoming probe, thereby allowing for elimination of the massive metal piston normally required by prior art, where the tube is carried on the female contact and the contact is pushed by the metal piston.

One of the preferred embodiments also uses a single component connector that functions as both the female connector and as the connector to the cylinder by the use of biasing finger portions of the connector.

Another of the preferred embodiments also provides a flexible connection from the female contact to the cylinder by means of a garter spring or louvered spring carried directly on a tubular body portion of the female contact, without need for an interposed metallic piston.

Another of the preferred embodiments, in addition to providing a removable plastic piston with a single component connector attached, also provides a removeable internally threaded rod contact that retains a bushing housing in a bushing well by threading to the stud of the bushing well. The rod contact may be assembled using a predetermined torque, to prevent breakage of the stud during installation.

Yet another of the preferred embodiments also provides for connection of a flexible cable directly to the body of the female connector and to the threaded stud of a bushing well, without need for an interposed piston.

The preferred embodiments use fewer conductive parts then were used in the equivalent prior art; therefore, there are fewer undesirable heat producing current interchange junctions between parts and there is a more rapid response to gas pressure.

DESCRIPTION OF THE PREFERRED EMBODIMENTS

Figure 1:
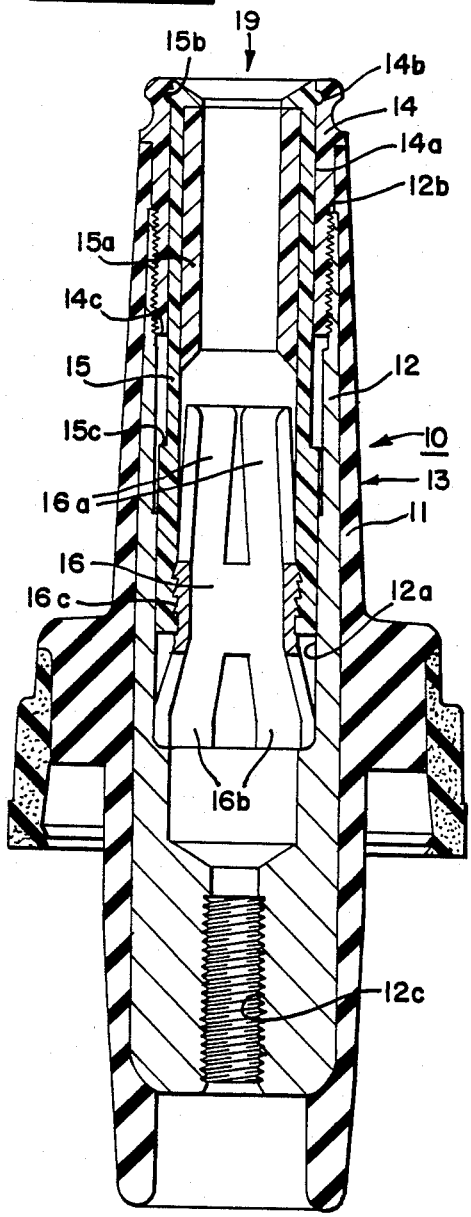
FIG. 1 is a sectional view of a high voltage bushing in accordance with a preferred embodiment of the present invention.

Referring now to FIG. 1, there is shown a new and improved high voltage separable insulated connector module. The module 10 in this case is a bushing insert designed to be threaded onto the stud of a bushing well such as used on pad mounted electrical transformers or switches. Other forms of the bushing may be used with the present invention. The bushing permits connection of the transformer by the closing of a mating elbow to the bushing, the elbow module including a probe contact member attached to a power cable.

The module 10 includes an elongated housing 13 formed of elastomeric material 11 molded onto a metallic piston cylinder 12 having a bore 12*a*. The cylinder includes screw threads at its remote ends, 12*b* and 12*c*. The threads 12*c* are for attachment to the mating threads of a stud within a bushing well. A nose piece 14 molded of resin such as nylon is screwed into the cylinder threads at 12*b*. Bore 14*a* through the nose piece 14 includes an annular groove 14*b*.

A snuffer tube 15 is configured to mate with and slidably extend within the bores 12*a* and 14*a* for performance as a piston. The snuffer tube 15 may be formed of a glass filled resin, and includes a concentrtic tube 15*a* formed of an ablative material such as described in U.S. Pat. No. 4,340,790. On one end, the tube 15 includes an annular boss 15*b*. while hot and pliable, the nose piece 14 is pushed onto the tube 15 to mate the boss 15*b* into the groove 14*b*. The nose piece 14 can then be rotated around the tube 15 while retaining relative axial position. At its other end, the tube 15 carries an elongated electrical connector unit 16. In this preferred emmbodiment, the connector unit 16 is shaped from a single mass of copper metal to include inwardly extending separated fingers 16*a* and outwardly extending separated fingers 16*b*. The fingers 16*a* are formed for slideable biased contact with an incoming probe. The fingers 16*b* are formed for slidable biased contact to the bore 12*a* of the cylinder 12. The central tubular portion of the contact unit 16 includes a series of annular serrations 16*c* locking the connector 16 into the tube 15, though any of several well known locking methods may be used here. When assembled warm, the tube 15 will adapt to the serrations 16*c*, that is, the dielectric resin forming the tube 15 will flow into the serrations 16*c* to hold the connector 16 firmly in place.

The contact assembly 19 consists of the snuffer tube 15 with nose piece 14 latched rotatably at one end and the connector 16 attached at its other end. The contact assembly 19 is removable and replaceable by rotation of the nose piece 14 in the threaded end 12*b* of the cylinder 12 and within the adjacent open end of the rubber dielectric 11. As the nose piece 14 is moved either inwardly or outwardly by rotation in the threads 12*b*, and the tube 15 and the contact 16 are carried along by the boss 15*b* mated into the groove 14*b*. The fingers 16*b* abut and are self biased to, and can smoothly slide along, the surface of the bore 12*a*, all the while maintaining good electrical contact.

Figure 4:
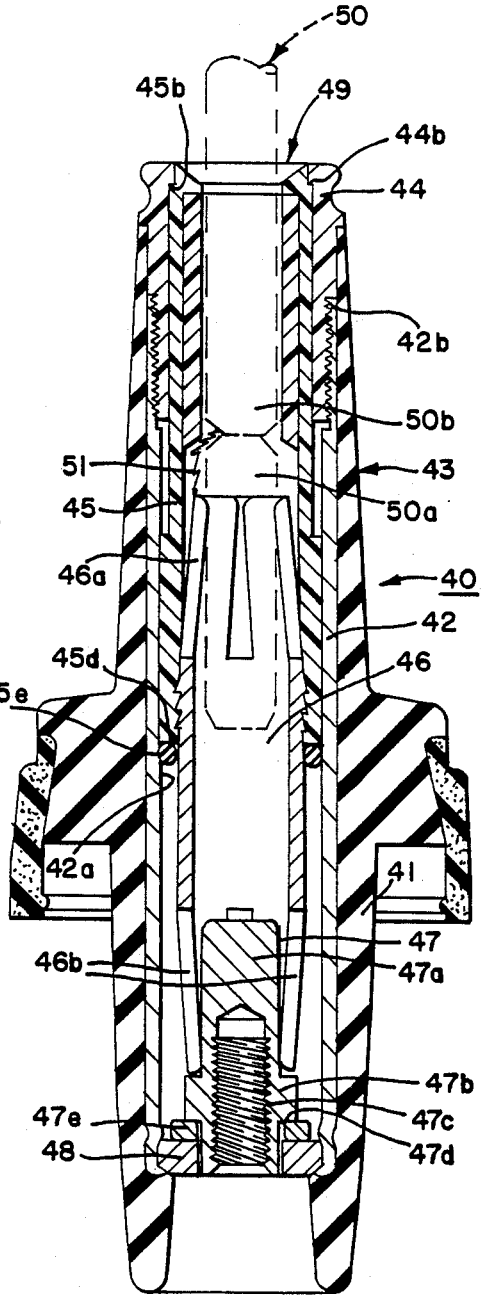
FIG. 4 is a sectional view of a preferred embodiment showing a high voltage bushing insert with a removable threaded rod connector and removable female contact and showing an incoming probe in phantom.

When the contact assembly 19 is operated under normal load current conditions, it remains in place, held by the boss 15*b* in the groove 14*b* which also serves as a seal to restrict the escape of any ionized gas to the exterior of the bushing 10 from along the outer surfaces of the tube 15. Ionized gases are formed by electrical arcing to the contact fingers 16*a* when a probe contact (not shown) is moved either into or out of contact with the fingers 16*a*. These gases increase in pressure in all open spaces within both the snuffer tube 15 and the cylinder 12, thereby tending to escape along the outer surfaces of the tube 15 and within the confining bore 12*a*. As an alternative to using the boss 15*b* as a gas seal, a rubber 0-ring may be installed between the connector 16 and the bore surface 12*a*, similar to O-ring 45*e*, installed between connector 46 and bore surface 42*a*, and against tube end surface 45*d*, all as shown in FIG. 4.

When the contact assembly 19 is operated under fault current conditions by moving a probe (such as probe 50 in FIG. 4) into the contact assembly 19 (FIG. 1) and toward engagement with the finger contacts 16*a*, an ensuing fault current arc (such as the arc 51 in FIG. 4) within the snuffer tube 15 (FIG. 1) will generate large amounts of gas and greatly increase the gas pressure within both the tube 15 and the cylinder 12. The increased pressure drives the tube 15 outwardly to snap out of engagement with the groove 14*b* and to pull the fingers 16*a* into immediate connection with the incoming probe contact, thereby extinguishing the arc and preventing further increase in pressure. Further movement of the contact assembly is restricted when a shoulder 15*c* formed at the midportion of the tube meets in overlapping contact with the inner end 14*c* of nose piece 14.

Figure 2:
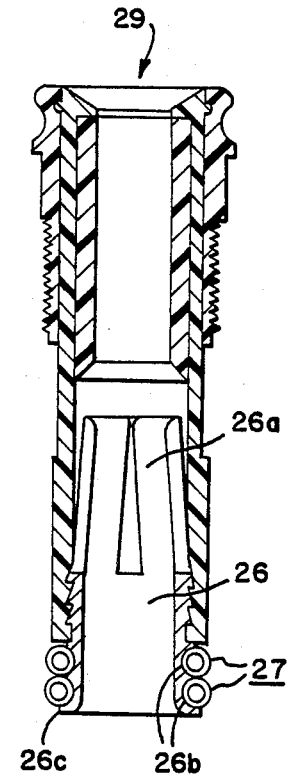
FIG. 2 is a sectional view of a contact assembly in accordance with another preferred embodiment of the present invention.

An alternative embodiment is shown in FIG. 2. Here the contact assembly 29 is shown as it appears before insertion into a housing such as the housing 13 shown in FIG. 1 or 43 in FIG. 4. Contact assembly 29 is identical in form and in operation to contact assembly 19 of FIG. 1 except that the fingers 16*b* have been replaced by annular grooved surfaces 26*b* and garter springs 27. When assembled into the housing of FIG. 1, the springs 27 will make a biased slideable electrical contact with the grooved surfaces 26*b* and with the cylinder bore surface 12*a*.

Figure 3:
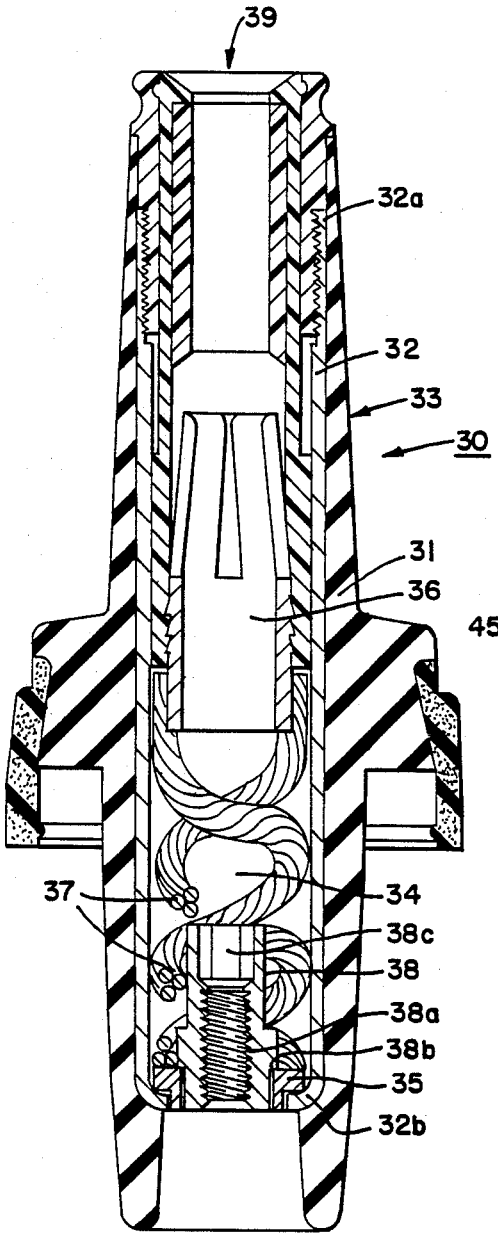
FIG. 3 is a sectional view of yet another preferred embodiment showing a high voltage bushing insert with a removeable flexible cable connection.

FIG. 3 shows another preferred embodiment as a bushing insert 30 that includes a housing 33 formed of elastomeric material 31 molded onto a piston cylinder 32. As shown, the cylinder 32 has been formed from a single length of drawn aluminum tubing, threaded at its top end 32*a* and formed inwardly at its bottom end to form an annular flange 32*b*. Mated with the cylinder 32 is contact assembly 39 which is identical in form and in operation to contact assembly 19 of FIG. 1 except that the fingers 16*b* have been replaced by flexible copper cables 37 and conductive ferrule 35. The cables 37 have been coiled to form an inner opening 34 to receive an incoming probe and to allow for the upward motion of the connector 36. The cables 37 are bonded at their ends to the connector 36 and to the ferrule 35 as by brazing, soldering or welding. Threaded nut 38 includes a threaded portion 38*a*, a hexagonal socket upper end portion 38*c* and a shoulder portion 38*b*.

The bushing insert 30 will be connected to the threaded stud of a mating bushing well (not shown) by inserting a hexagonal drive rod tool (not shown) axially through the contact assembly 39 and down into the socket 38*c*. Rotating the drive tool to a prescribed torque will then firmly tighten the threads 38*a* onto the bushing well stud while at the same time tightening the shoulder 38*b* firmly against the ferrule 35 to form a good electrical contact at the shoulder 38*b* and at the threads 38*a*. In turn, the ferrule 35 is thrust firmly against the flange 32*b* to retain the bushing 30 within the bushing well. The ferrule 35 may include a knurled surface for locking to the flange 32*b* to prevent rotation of the ferrule 35 during rotation of the nut 38. A solidly connected and reliable electrical load current and fault current path is herein provided from an incoming probe through the connector 36, through the nut 38 and into the threaded stud of a bushing well at threads 38*b*. Under fault current arcing conditions, the connector 36 is pulled upwardly onto a downwardly moving probe, similarly as previously explained as relating to FIG. 1.

Referring now to FIG. 4, the bushing insert 40 includes a housing 43 that is identical to the housing 33 of FIG. 3 except that a ferrule 48 is rigidly joined to the sleeve 42 as by crimping. The contact assembly 49 is identical in form and function to the contact assemblies 19, 29 and 39 of FIGS. 1–3 except that the connector 46 includes four elongated fingers **46*b*, identical to fingers 46*a* and to the fingers 16*a* of FIG. 1, that are provided for biased slideable connection to the rod contact nut 47. Nut 47 includes an uppermost rod portion 47*a*, a hexagonally formed portion 47*b* that includes a shoulder 47*d*, an internally threaded portion 47*c* and a spring washer 47*e* that is retained under the shoulder portion 47*d* as by a slight interference fit before assembly of the nut 47 into the housing 43**.

The bushing insert 40 may be assembled to a bushing well similarly as the insert 10 of FIG. 1, that is, it may be placed into the well and manually rotated to seat the threaded portion **47*c* firmly onto the threaded stud of a mating bushing well. Alternately, the housing 43 may first separately be set into a bushing well. Then the nut 47 with retained spring washer 47*e* may be placed into a suitable hexagonal socket and drive rod tool (not shown), inserted down through the cylinder 42, and threaded onto the stud of the bushing well using a predetermined value of torque. The predetermined torque will assure that the bushing stud will not be broken during assembly, that the spring washer 47*e* is fully compressed as shown in FIG. 4, and that the insulation 41 is properly set into the mating cavity of the bushing well. The tool is then withdrawn. The contact assembly 49 is then inserted into the housing 43, with the fingers 46*b* being inserted first and lastly the nose piece 44. Upon the initial engagement of the nose piece 44 at the threads 42*b*, the fingers 46*b* are making initial contact at the upper end of rod 47*a*. The nose piece 44 is then rotated to complete both its engagement into the threads 42*b* and the full engagement of the fingers 46*b* onto, around, and abutting the rod 47*a*. When the incoming probe 50 (shown partially inserted in dashed lines) is fully inserted, the bushing 40 provides an excellent electrical connection between the copper probe contact 50*b* and the threaded bushing well stud now seated in the threads 47*c*. The copper connector 46 provides a biased slideable connection to the probe contact 50*b* through the fingers 46*a* and to the rod nut 47 through the fingers 46*b*. The copper rod nut 47** in turn makes a solid threaded connection to the bushing well stud.

The assembly method described above is readily reversed. Thus, all load current and fault current carrying components of the bushing 40, namely the contact assembly 49 with its connector 46 and the rod nut 47, are readily removeable from and replaceable within the bushing housing 43, similarly as are the contact assembly 39 and the threaded nut 38 removeable and replaceable from and in the housing 33 in FIG. 3.

When assembled to a bushing well of an electrical apparatus, the bushing insert 40 is used as a switching module in cooperation with the insertion or removal of the probe 50 (shown in phantom dashed lines) of a mating elbow module connected to an insulating power cable. Under load current switching, the arc 51 may occur either during insertion or removal of the probe, from the copper contact portion **50*b*, across the surface of the ablative follower portion 50*a*, and to a finger 46*a* of connector 46. Gases generated by the arc expand and pass down between the fingers 46*b* and upwardly between the connector 46 and confining cylinder 42 to press against the piston surface 45*d* of the tube 45. If an O-ring gas seal 45*e* is interposed as shown, the gases will press against the O-ring, which will in turn press up against the piston surface 45*d*. Deletion of the O-ring 45*e* allows a portion of the gases to expand upwardly along the tube 45, but to be restricted from escaping to the exterior of the module by the sealing abutment of the extremity of the nosepiece 44 to the extremity of the tube 45 above the shoulder 45*b***.

Under the pressure developed by load current switching, the contact assembly will remain in place. However, when the arc 51 is a fault curent arc struck between an incoming probe contact **50*b* and connector 46, the gas expansion and resultant pressure against the piston surface 45*d* will be so great as to cause the tube 45 to move upwardly, overwhelming the opposing retainment force presented by the shoulder 44*b* of the nosepiece 44 overlaying the mating shoulder 45*b* of the tube 45, thereby either expanding or breaking the nosepiece 44, depending upon design choice, to allow the upward movement of the tube 45. The upward movement of the tube pulls the contact 46 up to close its fingers 46*a* to the incoming contact 50*b* to extinguish the arc 51**.

Each of the contact assemblies 19, 29, 39 49 of FIGS. 1–4 will react in like manner to the gas pressure development by either a load current or a fault current arc, as explained above.

In FIG. 1–4 the contact units 16, 26, 36 and 46 are preferably formed from a length of copper tubing. The tube is slotted and bent to form the biasing fingers **16*a*, 16*b*, 26*a*, 36*a*, 46*a* and 46*b* and turned to form the serrations 16*c* and the annular surfaces 26*b*. At an end 26*c* adjacent the surfaces 26*b*, the tube is flared to extend beyond its original outer diameter to provide flange means for retaining the flexible members 27** in position on the contact unit during movement caused by fault current arcing.

In high volume production, the connector 46 of FIG. 4 may most preferably be stamped from sheet metal as semi-circular halves, each half including four biasing elongated fingers, two at each end. The halves may then be joinged together to form the connector 46 with a tubular mid portion and with four fingers **46*a* and 46*b* extending from each opposing end. The two halves of the connector 46 may also be held together by a metallic ring (not shown) over its tubular mid portion or over the elongate fingers 46*a* or 46*b***.

Obviously, many modifications and variations of the present invention are possible in light of the above teachings. Thus, it is understood that, within the scope of the appended claims, the invention may be practiced otherwise than as specifically described above.

What is claimed is:

1. A separable insulated connector module for electrical connection to another component of an electrical distribution system and to an incoming probe of a mating elbow module comprising an elongated housing having a bore, an elongated conductive connector having first and second extremities, means for making said electrical connection to said other component, an elongated dielectric tube adapted for movement along said bore upon the occurrence of a fault current arc formed within said tube, said first extremity of said elongated connector being disposed within said dielectric tube and being adapted for making a conductive connection to said probe, said second extremity of said elongated connector comprising means for connecting to said electrical connection making means, said elongated connector including an elongated continuous portion of metal comprising a first elongated finger portion of said first extremity and a second elongated finger portion of said connecting means of said second extremity, said second finger portion being disposed in abutting contact with said electrical connection making means.

2. The connector module defined in claim 1 further comprising a tubular dielectric nosepiece, and wherein said housing further includes means for retaining said tubular nosepiece within said bore, said nosepiece being disposed and retained within said bore by said retaining means, said dielectric tube having a portion mating to and slidable axially within said nosepiece, and wherein said nosepiece includes an integrally formed first portion for releasably retaining said tube within said bore, said tube includes an integrally formed second portion complimentarily shaped to and in engagement with said first portion of said nosepiece, and said first portion is configured to yield to release said second portion of said tube from said bore upon said occurrence of a fault current arc within said tube.

3. A separable insulated connector module for electrical connection to another component of an electrical distribution system and to an incoming probe of a mating elbow module comprising an elongated housing having a bore, an elongated conductive connector having first and second extremities, means for making said electrical connection to said other component, an elongated dielectric tube adapted for movement along said bore upon the occurrence of a fault current arc formed within said tube, said first extremity of said elongated connector being disposed within said dielectric tube and being adapted for making a conductive connection to said probe, said second extremity of said elongated connector comprising means for connecting to said electrical connection making means, said electrical connection making means being disposed within said bore and being readily removable from and replaceable within said bore.

4. The connector module as defined in claim 3 wherein said means for connecting to said electrical connection making means comprises a length of flexible conductive cable having an end portion diposed in abutting connection to a conductive ferrule that is installed within said bore and is adapted to be readily removable from and replaceable within said bore.

5. The separable insulated connector module as defined in claim 3 further comprising a spring washer assembled and retained captively on said electrical connection making means both prior to and after the assembly of said electrical connection making means into said bore.

6. A separable insulated connector module for electrical connection to another component of an electrical distribution system comprising means for making said electrical connection to said other component, an elongated housing having a bore and including means for retaining a tubular nosepiece within said bore, said nosepiece being disposed and retained within said bore, and an elongated dielectric tube disposed within said bore and having a portion mated to and slidable axially within said nosepiece, said nosepiece including first integrally formed means for releasably retaining said tube within said bore, said tube including second integrally formed means, complimentarily shaped to said first means, for engaging said first means to releaseably retain said tube within said bore, said first means being configured to yield to release said tube for outward movement along said bore upon the occurrence of fault current arcing within said tube.

* * * * *